US009261028B2

(12) United States Patent
Seymour, II et al.

(10) Patent No.: US 9,261,028 B2
(45) Date of Patent: Feb. 16, 2016

(54) GOVERNOR SYSTEM ASSEMBLY

(71) Applicant: Kohler Co., Kohler, WI (US)

(72) Inventors: Kenneth R. Seymour, II, Plymouth, WI (US); Jeffrey L. Bracht, Cascade, WI (US); Jennifer J. Van Dalen, Howards Grove, WI (US); William H. Sharp, Petal, MS (US); Sami M. Chukrallah, Sheboygan, WI (US); Andrew J Sugden, Sheboygan Falls, WI (US); James L. Webster, Elkhart Lake, WI (US)

(73) Assignee: KOHLER CO.

( * ) Notice: Subject to any disclaimer, the term of this patent is extended or adjusted under 35 U.S.C. 154(b) by 298 days.

(21) Appl. No.: 13/945,322

(22) Filed: Jul. 18, 2013

(65) Prior Publication Data

US 2015/0020774 A1 Jan. 22, 2015

(51) Int. Cl.
*F02D 9/02* (2006.01)

(52) U.S. Cl.
CPC ..... *F02D 9/02* (2013.01); *F02D 2009/0203* (2013.01)

(58) Field of Classification Search
CPC ..... F02D 9/02; F02D 2009/0203
USPC ..... 123/363, 376, 403
See application file for complete search history.

(56) References Cited

U.S. PATENT DOCUMENTS

| | | | | |
|---|---|---|---|---|
| 4,123,942 | A | 11/1978 | Rumyantsev | |
| 4,254,753 | A | 3/1981 | Ritter et al. | |
| 4,463,720 | A | 8/1984 | Ritter | |
| 4,637,270 | A | 1/1987 | Yanagiuchi et al. | |
| 4,656,980 | A | 4/1987 | Ohkoshi | |
| 4,977,879 | A | 12/1990 | Schmidt et al. | |
| 5,065,720 | A | 11/1991 | Nishiyama et al. | |
| 5,131,361 | A | 7/1992 | Hartmann et al. | |
| 5,325,831 | A | 7/1994 | Handa | |
| 5,497,747 | A | 3/1996 | Nakano et al. | |
| 5,857,441 | A | 1/1999 | Yonezawa et al. | |
| 5,894,756 | A | 4/1999 | Uehara et al. | |
| 6,901,909 | B2 | 6/2005 | Kajihara et al. | |
| 2012/0055447 | A1 * | 3/2012 | Yano et al. | 123/400 |

* cited by examiner

*Primary Examiner* — Hai Huynh
(74) *Attorney, Agent, or Firm* — Frank J. Spanitz

(57) ABSTRACT

A governor system assembly and related method for assembling the same. The assembly may include a governor gear, a weight, and a locking pin pivotably coupling the weight to the governor gear along a pivot axis. The locking pin includes a locking segment rotatable into engagement with the gear about the pivot axis for securing the pin to the gear. In one assembly, the locking pin is rotatable between an unlocked position in which the locking pin is axially removable from the gear and a locked position in which a locking pin is not axially removable when the locking segment engages the gear. The locking pin may be L-shaped in some assemblies.

19 Claims, 21 Drawing Sheets

GOVERNOR SYSTEM ASSEMBLY

BACKGROUND OF THE INVENTION

The present invention generally relates to internal combustion engines, and more particularly to governor systems of internal combustion engines.

Governor systems are used to regulate the speed of internal combustion engines which may be used in various types of power equipment and motorized vehicles. A governor gear is a part of the governor system which helps limit and protect the engine from excessive rotational speeds in addition to allowing the engine to respond to changes in load without significantly changing the speed.

A governor system for an engine is desirable.

SUMMARY OF THE INVENTION

According to one aspect of the present disclosure, a governor system assembly for an engine includes a governor gear, a weight, and a locking pin pivotably coupling the weight to the governor gear along a pivot axis. The locking pin has a locking segment selectively rotatable into and out of engagement with the governor gear about the pivot axis for securing the locking pin to the governor gear. The locking pin is rotatable between an unlocked position and a locked position in which a locking segment engages the governor gear.

According to another aspect of the present disclosure, a governor system assembly for an engine includes a governor gear defining a locking slot, a weight, and a locking pin having a hinge segment pivotably coupling the weight to the governor gear along a pivot axis, and a locking segment rotatable into and out of engagement with the locking slot of the governor gear about the pivot axis. The locking pin is selectively rotatable between an unlocked position and a locked position in which the locking segment engages the locking slot. In one non-limiting example, the locking pin may be generally L-shaped.

According to another aspect of the present disclosure, a method for assembling a governor system assembly is provided. The method includes: providing a governor gear, a weight, and a locking pin; locating the weight on the governor gear; axially inserting a first segment of the locking pin through the weight and governor gear, the weight being pivotably coupled to the governor gear along a pivot axis; rotating a second segment of the locking pin about the pivot axis; and engaging the second segment with the governor gear, wherein the locking pin is locked to the governor gear.

BRIEF DESCRIPTION OF THE DRAWINGS

The features of the innovation will be described with reference to the following drawings where like elements are labeled similarly, and in which.

Figure 1:
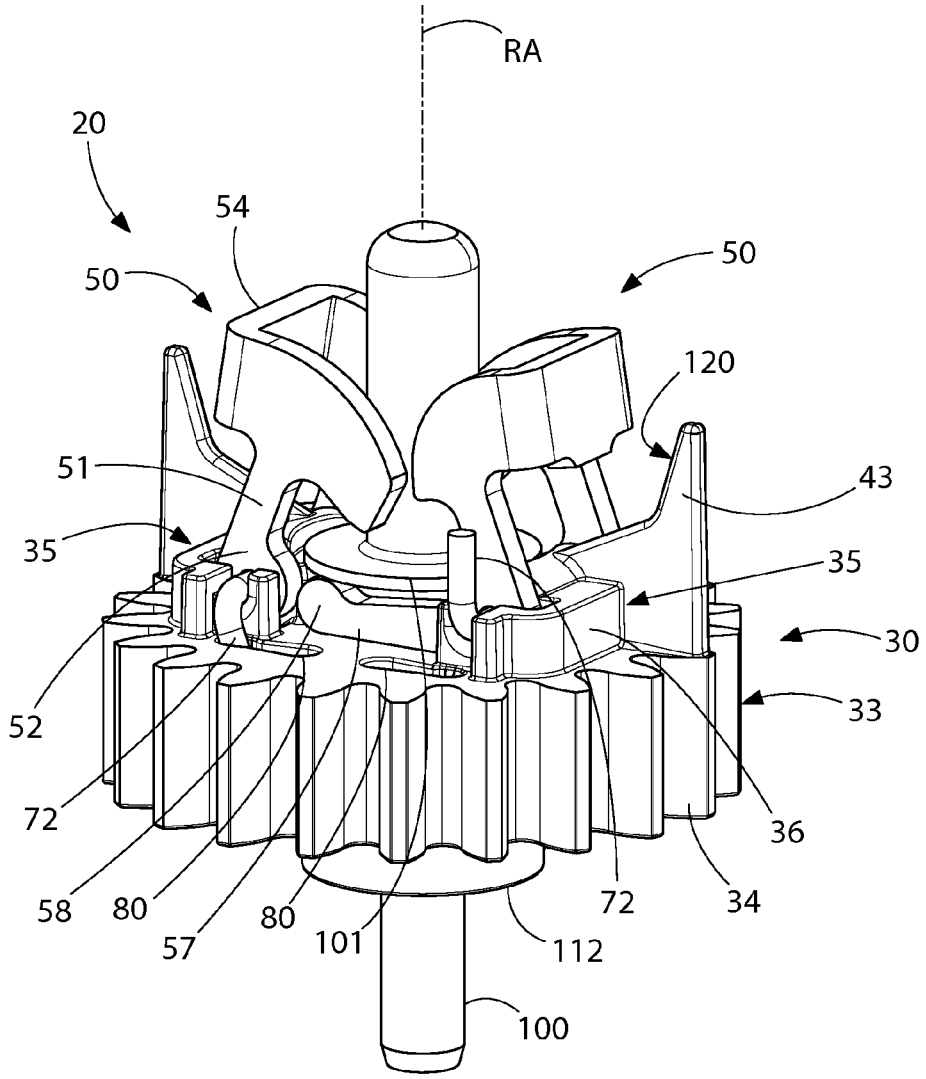
FIG. 1 is a top perspective view of an example governor system assembly.
Figure 2:
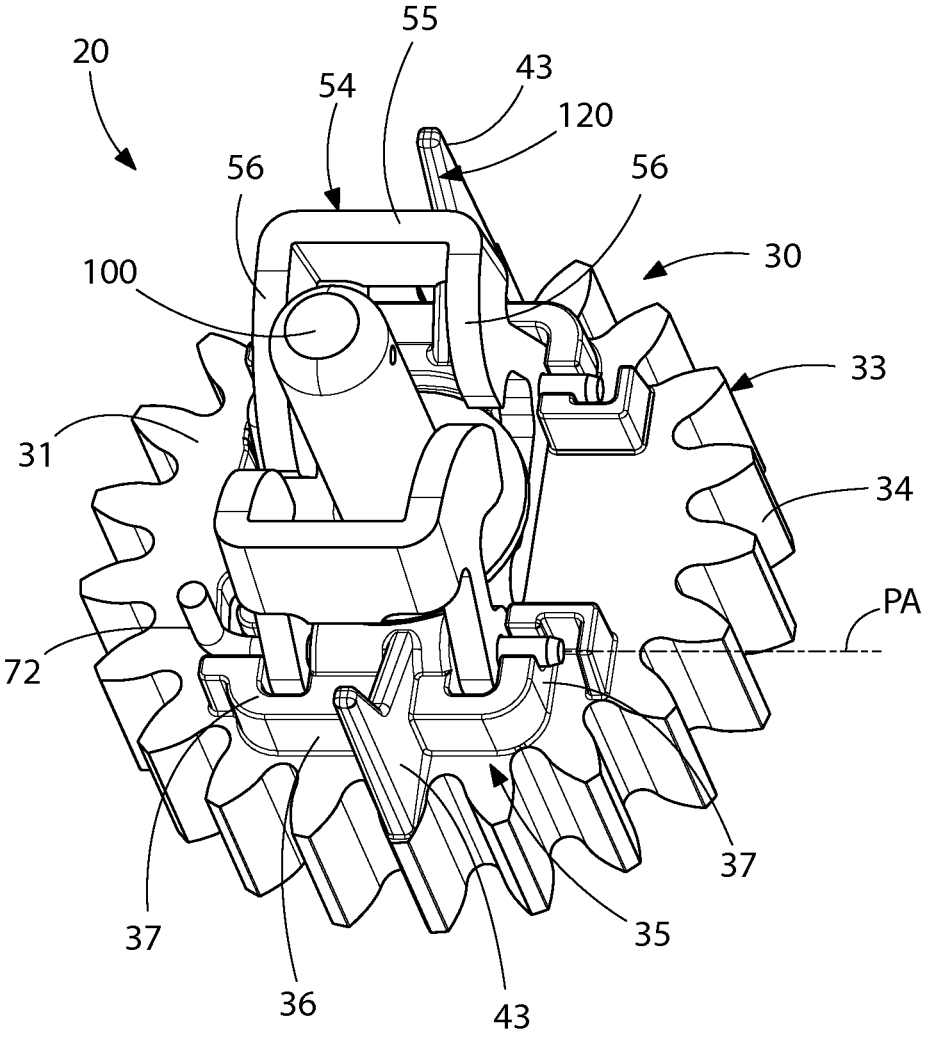
FIG. 2 is another top perspective view thereof from a steeper angle of view.
Figure 3:
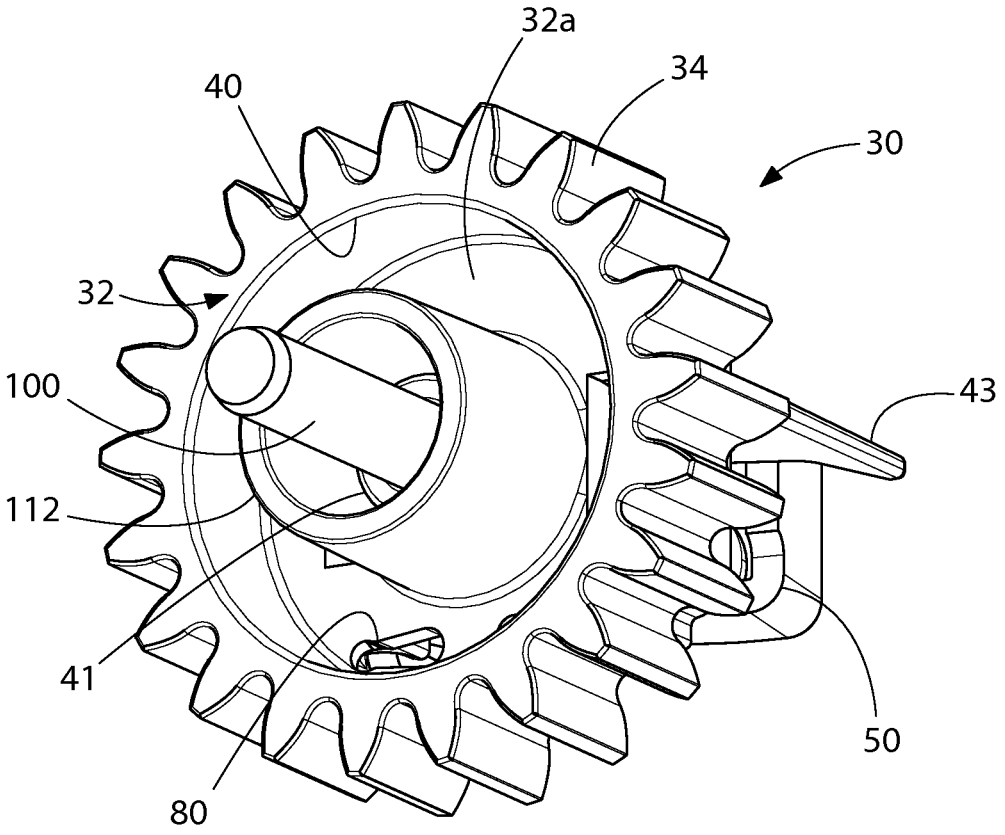
FIG. 3 is bottom perspective view thereof.
Figure 4:
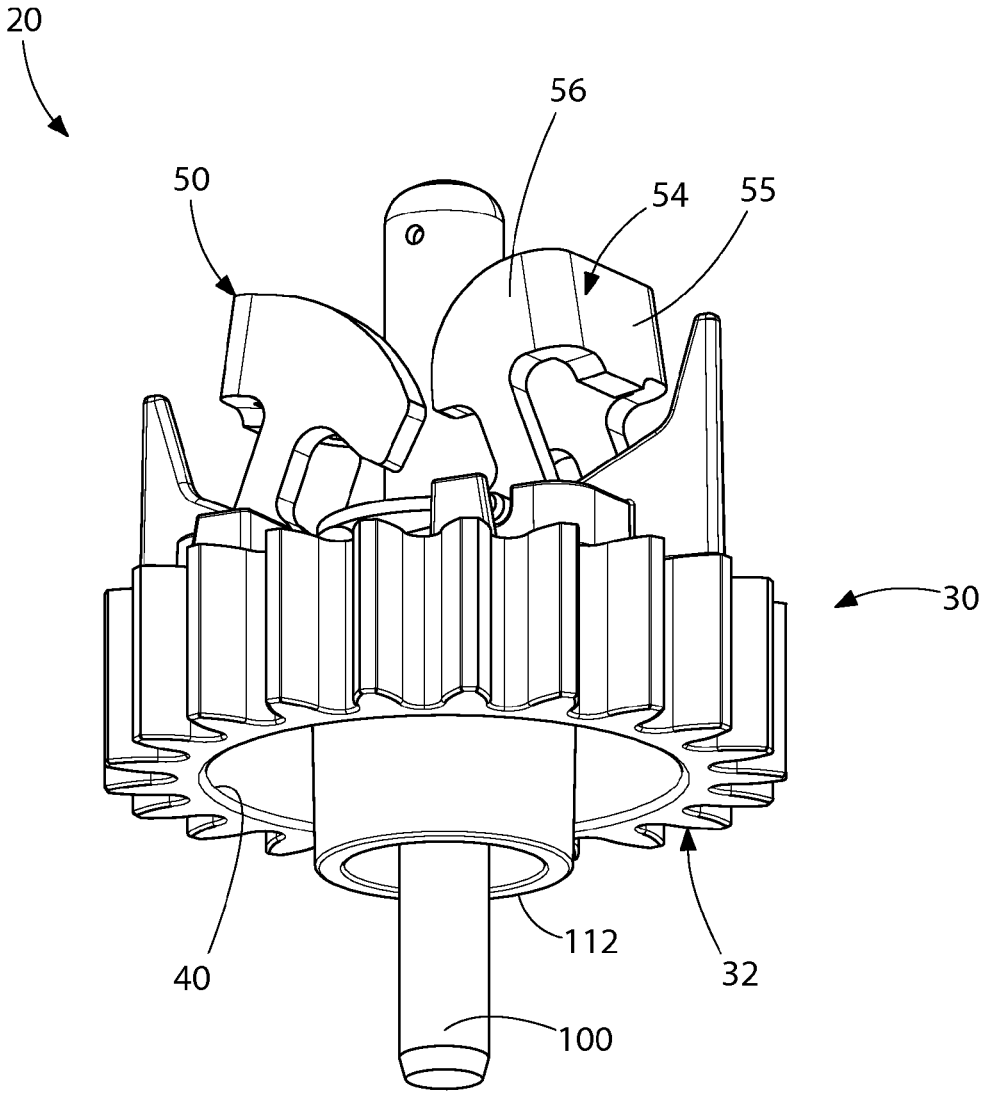
FIG. 4 is another bottom perspective view thereof.
Figure 5:
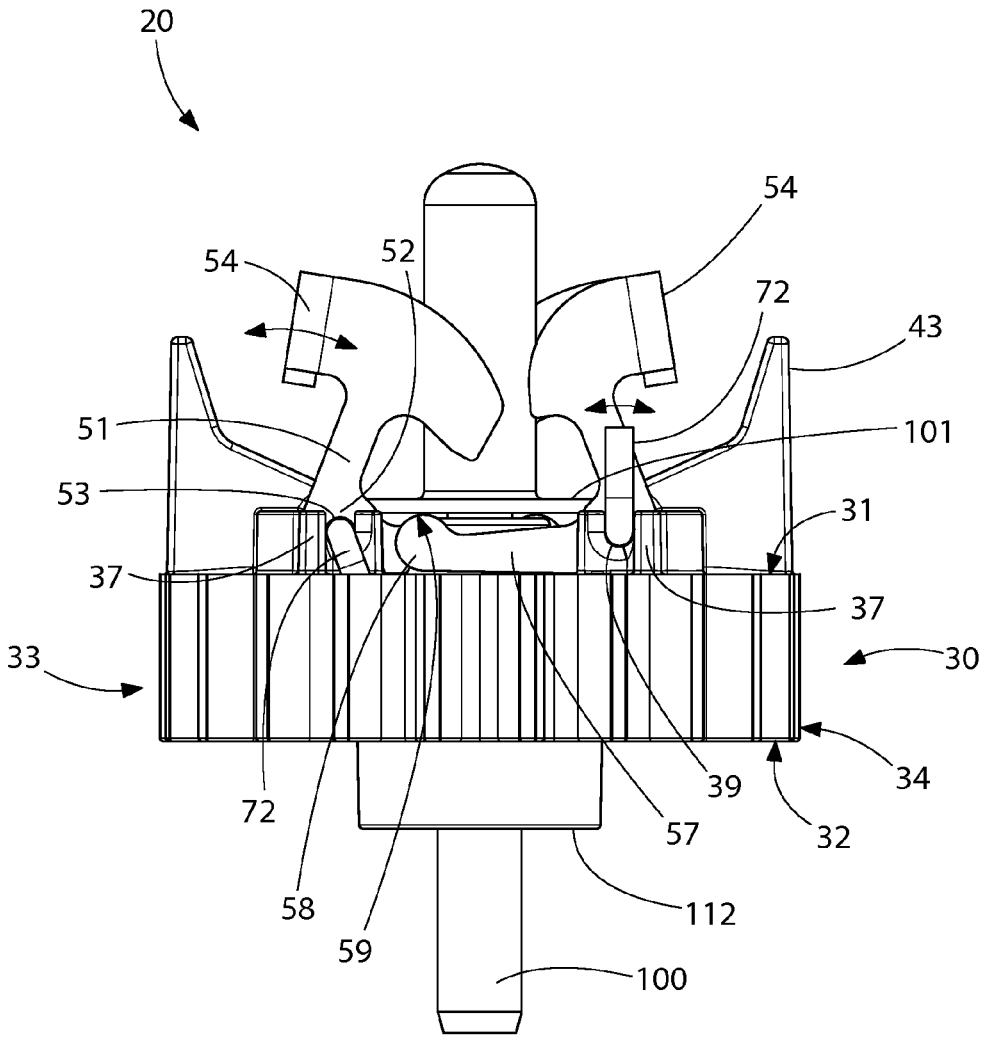
FIG. 5 is a front view thereof.
Figure 6:
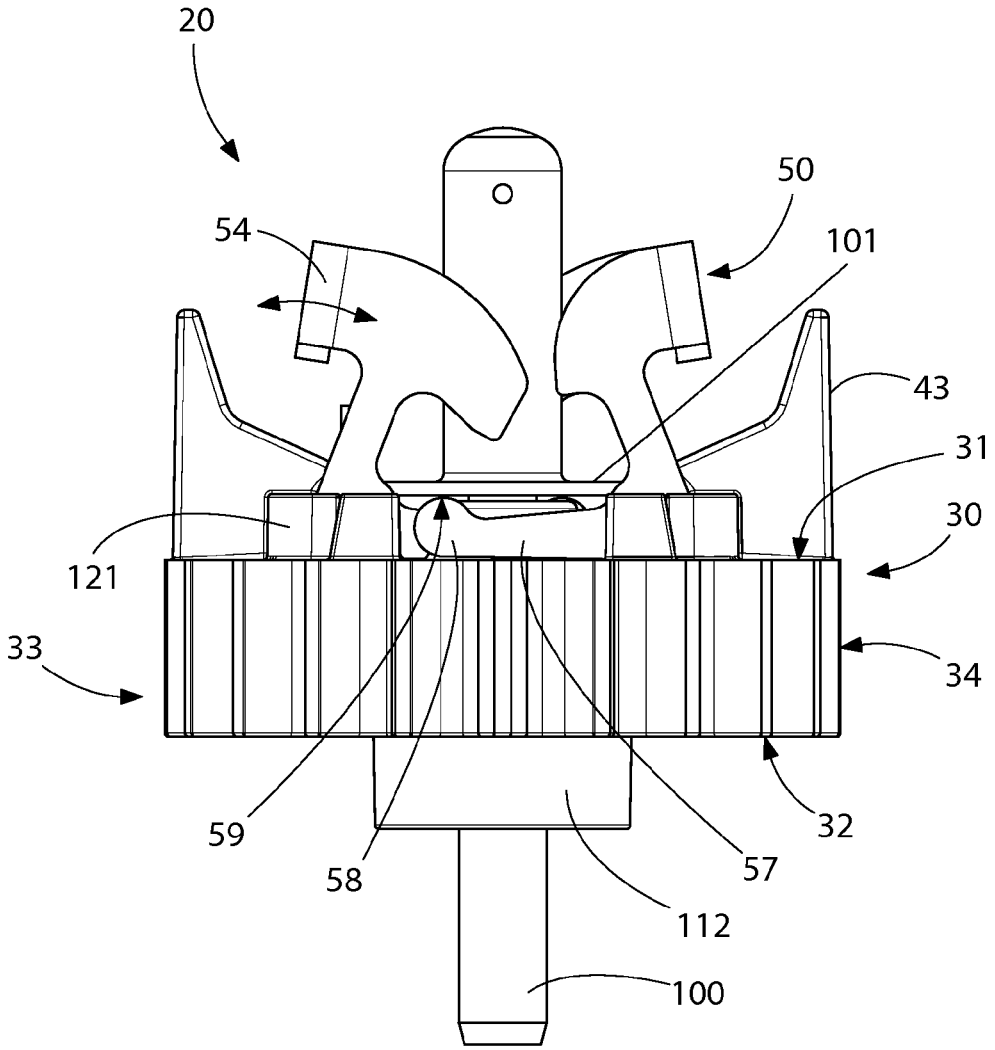
FIG. 6 is a rear view thereof.
Figure 7:
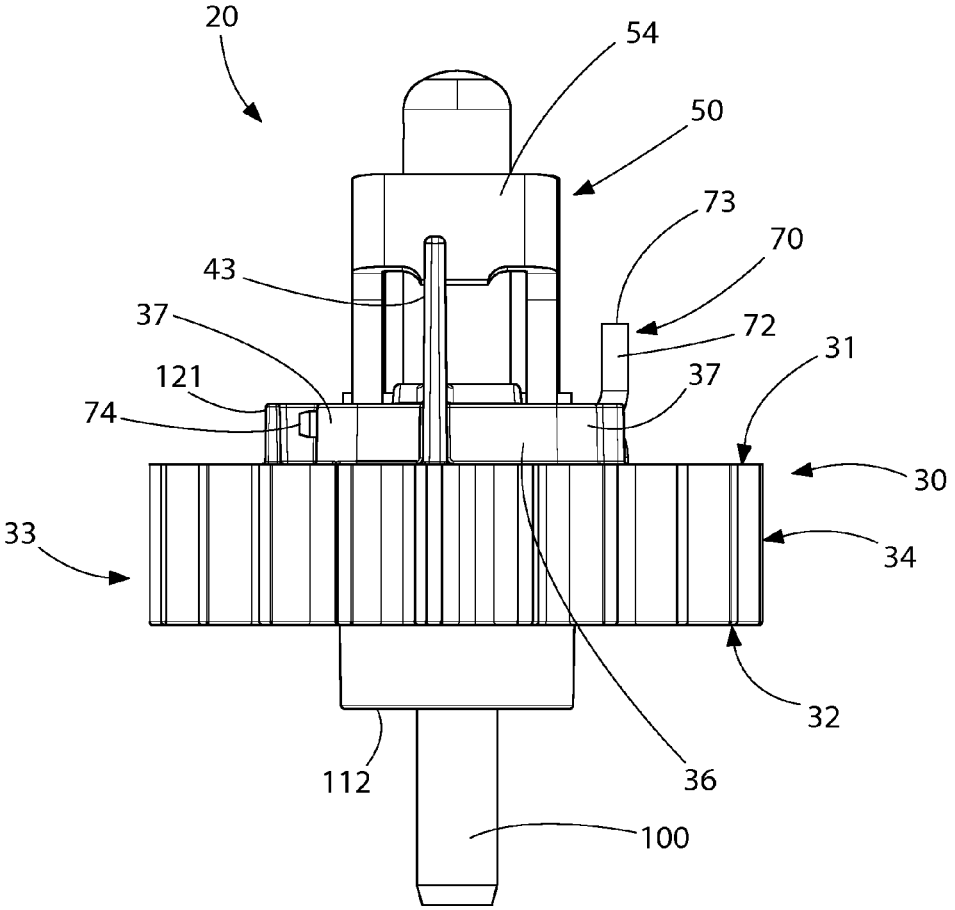
FIG. 7 is a first side view thereof.
Figure 8:
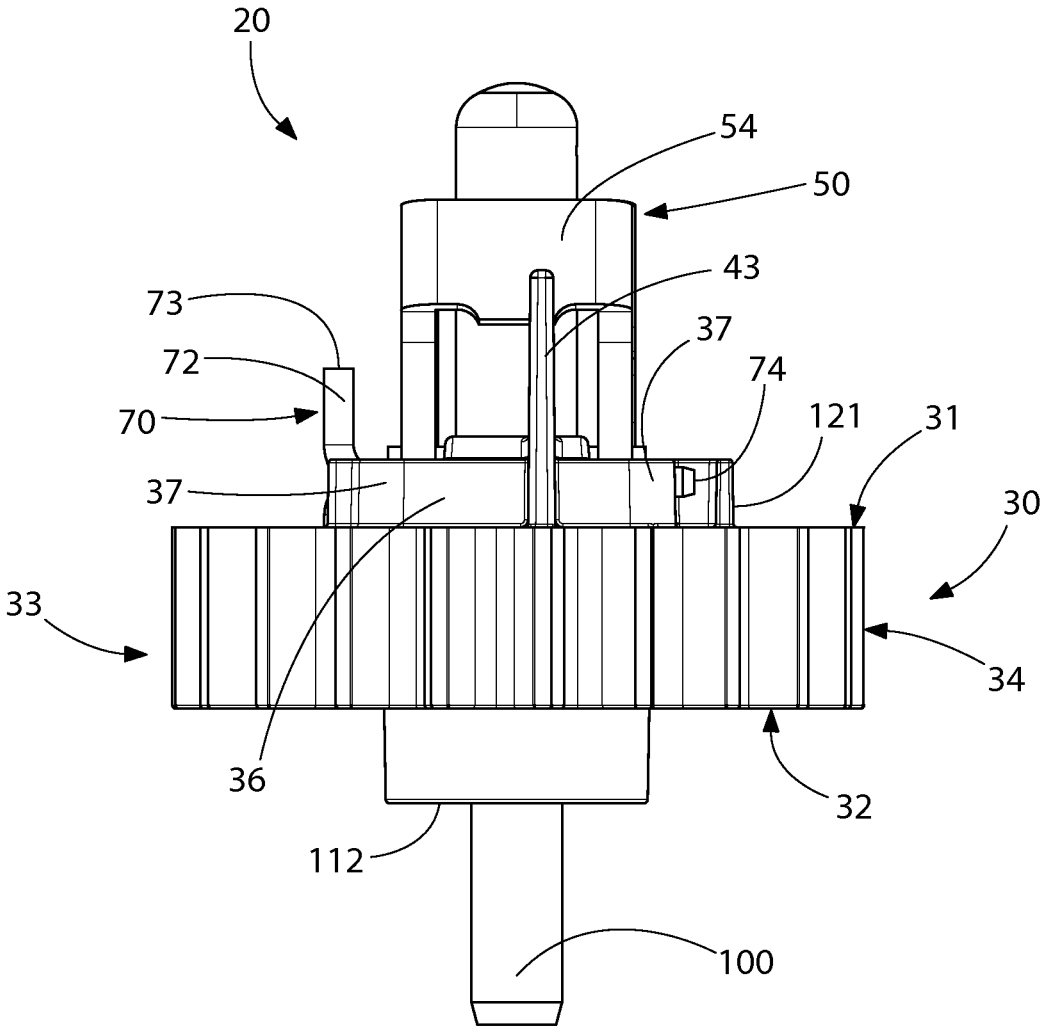
FIG. 8 is a second side view thereof.
Figure 9:
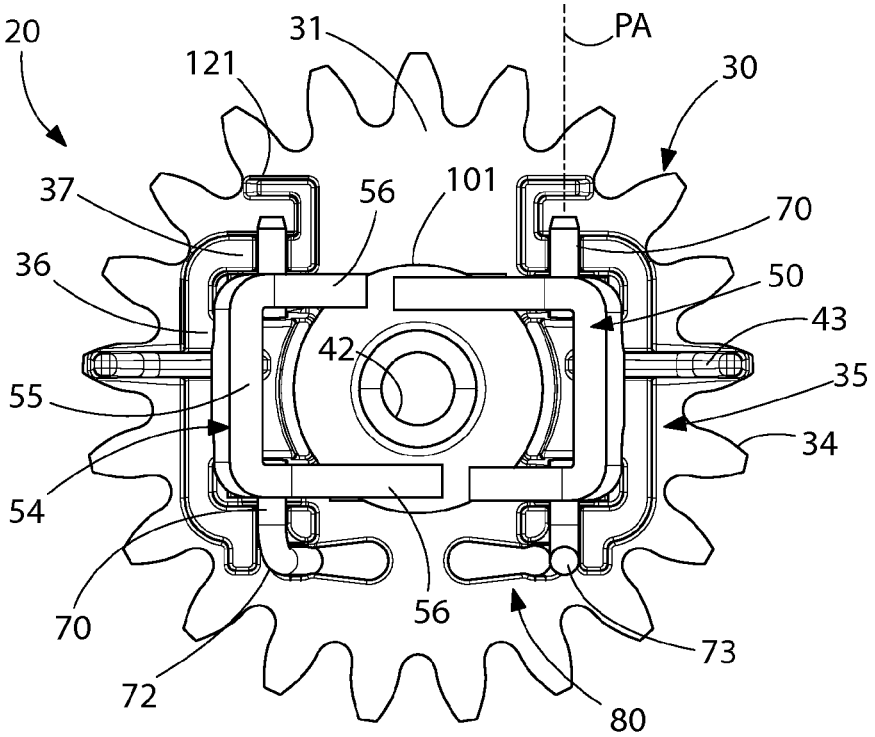
FIG. 9 is a top plan view thereof.
Figure 10:
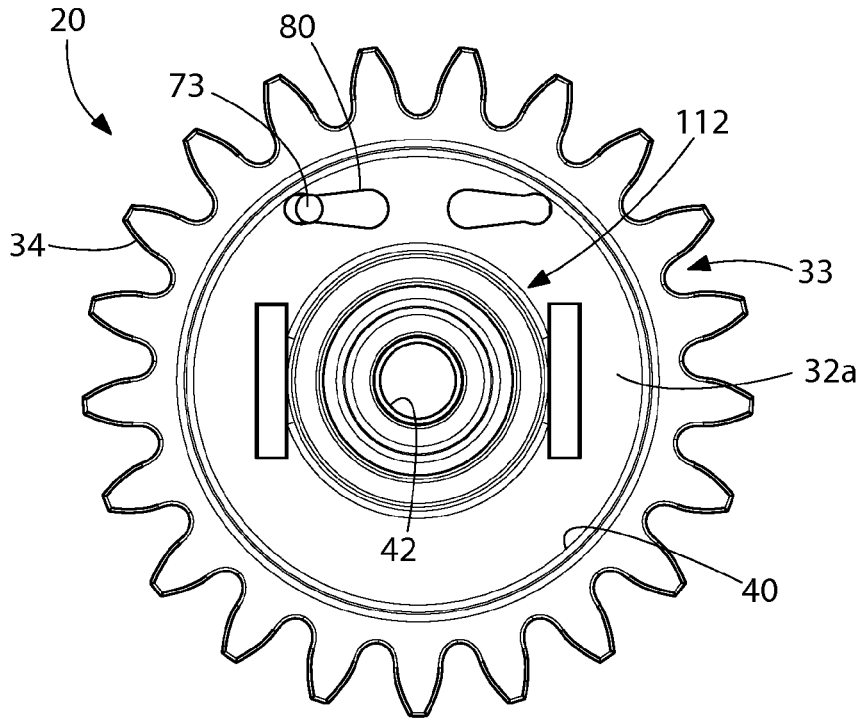
FIG. 10 is a bottom plan view thereof.

All drawings are schematic and not necessarily to scale.

DETAILED DESCRIPTION OF EMBODIMENTS

The features and benefits of the present disclosure are illustrated and described herein by reference to exemplary systems and methods (generally referred to as "systems"). This description of exemplary systems is intended to be read in connection with the accompanying drawings, which are to be considered part of the entire written description. Accordingly, the present disclosure expressly should not be limited to such systems illustrating some possible non-limiting combination of features that may exist alone or in other combinations of features; the scope of the claimed invention being defined by the claims appended hereto.

In the description disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "affixed," "connected," "interconnected," and the like refer to a relationship wherein structures are secured or attached to one another either directly or indirectly through intervening structures, as well as both movable or rigid attachments or relationships, unless expressly described otherwise.

Referring to FIGS. 1-10, a governor system assembly 20 in one example may include a governor gear 30, a pair of weights 50, and locking pins 70. While the present description may refer to a governor gear 30, it should be appreciated that in some example systems, the rotating component of the governor system assembly 20 that spins the weights 50 may not be an actual gear. Rather, the gear 30 of the governor system assembly 20 may be, or may be replaced by, a base which may be driven or rotated in various other ways, such as by a belt, a cam shaft (such as when the components of the gear are pressed on to an end of the cam shaft), or in various other ways. Various other examples are possible.

In some example systems, the governor gear 30 may include a top surface 31, bottom surface 32, and peripheral sides 33. The governor gear 30 may be a generally circular or cylindrical gear with a plurality of gear teeth 34 extending circumferentially around the gear. In other systems, the governor gear 30 may be various other shapes. Top surface 31 may be substantially flat or planar. In other example systems, the top surface 31 may be other shapes or have a non-planar surface. Bottom surface 32 may include a downwardly open cavity 40 circumscribed by peripheral sides 33 of the governor gear 30. The downwardly open cavity 40 may define a recessed surface 32*a*.

The central portion of governor gear 30 includes a hub 41 defining opening 42 configured to receive a portion of governor shaft 100 there through. The governor shaft 100 may rotationally mount the governor gear 30 in the engine. In one configuration, hub 41 may include cylindrical raised portions extend upwardly from top surface 31 and downwardly from recessed surface 32*a* of the gear as further shown in FIG. 12. Governor gear 30 may further include a tubular sleeve 112 depending downwards from recessed surface 32*a*. In some systems, the tubular sleeve 112 may have a greater diameter than the hub 41, and may surround a portion of the hub 41 that extends downwardly from the recessed surface 32*a*.

Figure 11:
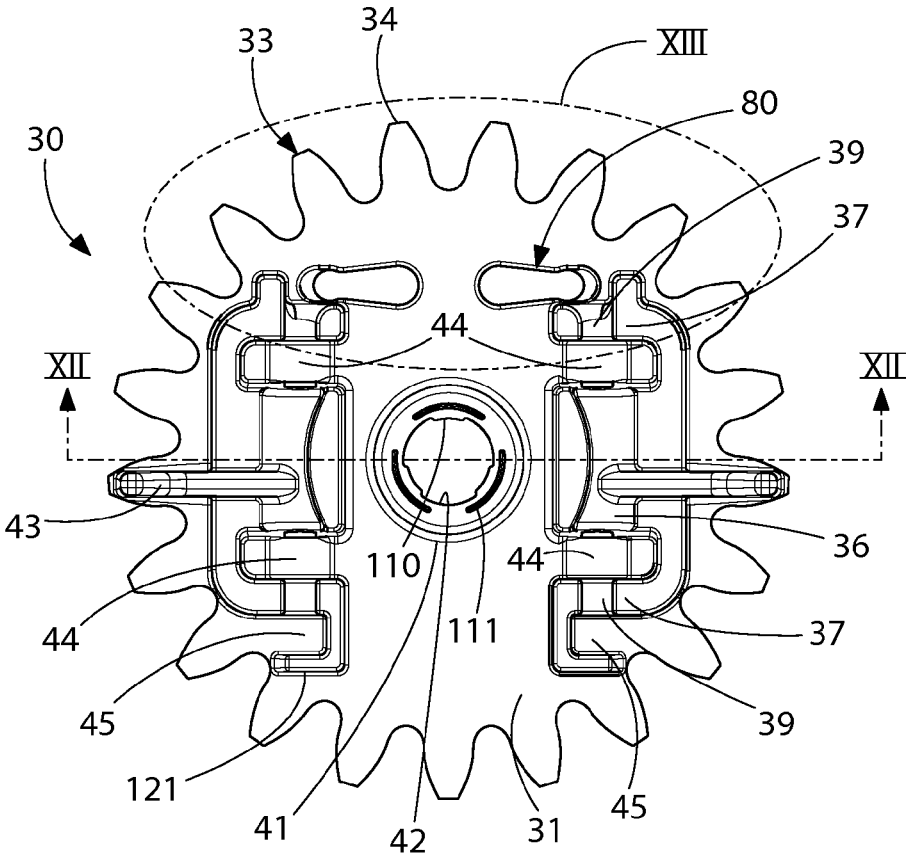
FIG. 11 is top plan view of an example governor gear.
Figure 12:
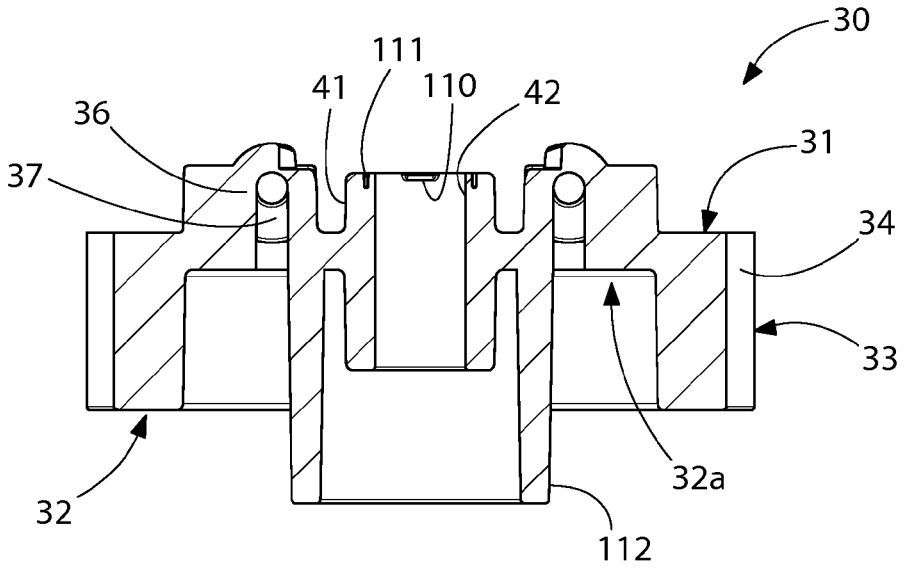
FIG. 12 is a cross-sectional view thereof.
Figure 24:
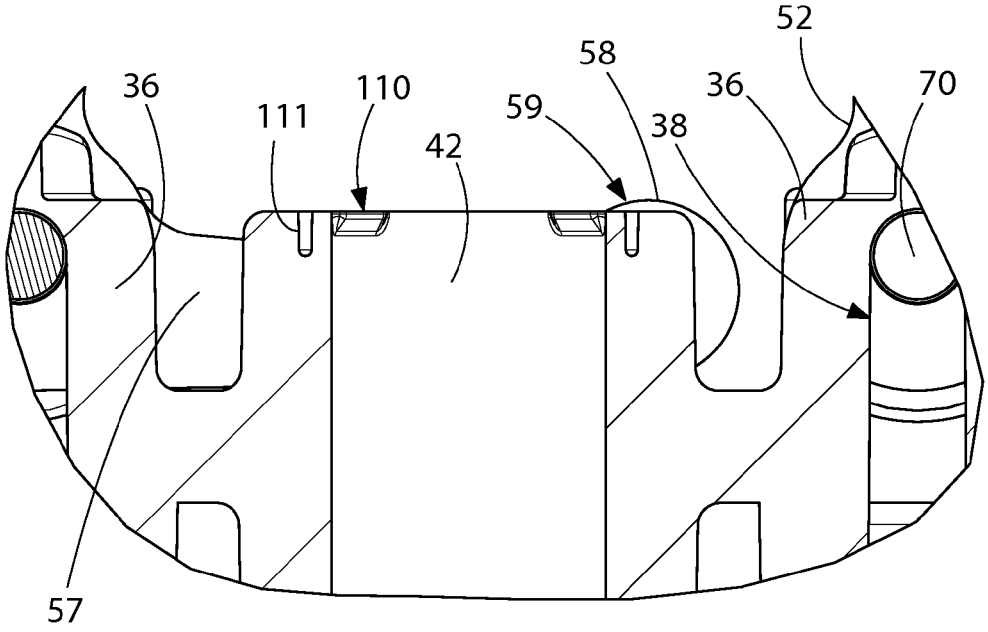
FIG. 24 is a cross-sectional view through an example governor gear showing details of the hub.
Figure 25:
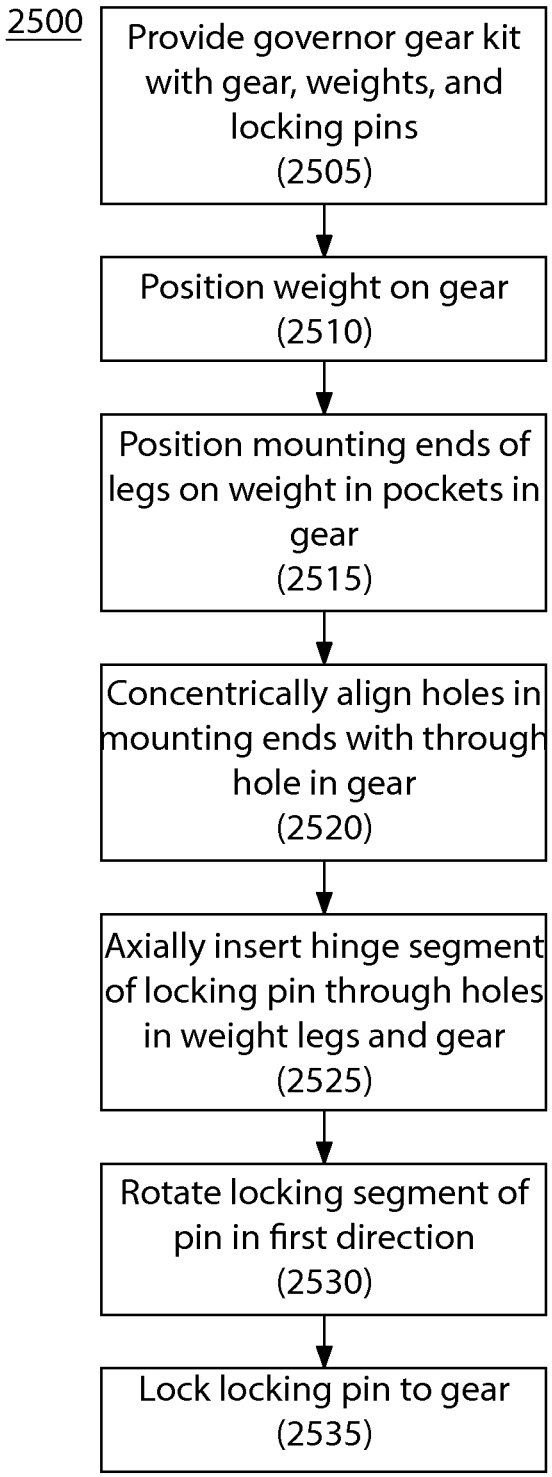
FIG. 25 is a flow chart of an example method for assembling a governor gear.

In an example governor gear configuration shown in FIGS. 11, 12, and 24, hub 41 may include a plurality of lips 110 which protrude radially inwards towards opening 42 for frictionally engaging governor shaft 100. The lips 110 may serve to temporarily hold the governor gear 30 in place on the shaft while the engine is being assembled and/or to retain the gear during operation. To enhance radial flexibility of the lips 110 for this purpose, a plurality of associated arcuately curved channels 111 may be disposed adjacent and proximate to the lips 110. The lips 110 and channels 111 may allow for easy assembly while making it difficult to disassemble. The channels 111 may enable the deflection of material around the lips 110 without over-stressing the material around the lips 110. Other variations are possible.

Governor gear 30 may be made of any suitable material. In one representative example, without limitation, governor gear may be made of plastic such as without limitation nylon (polyamide). In one example, the governor gear 30 may be made of a 40% mineral filled nylon (polyamide 66). In some examples, the governor gear 30 may include molybdenum disulfide. The governor gear 30 may be formed by injection molding when made of plastic. Other suitable non-metallic and metallic materials, however, may alternatively be used.

Each of the weights 50 may be pivotably coupled to governor gear 30 and operable to move in opposing inward and outward radial directions such that they are in equilibrium with the torque provided by the governor spring. In one example assembly, weights 50 may each include a weight element 54 and a pair of mounting legs 51 horizontally/laterally spaced apart. Mounting legs 51 may elevate the weight element 54 above the top surface 31 of governor gear 30. One or both of the free ends of mounting legs 51 may be terminated with an enlarged (i.e. in relation to upper portions of each leg) and generally bulbous mourning end 52 having a hole 53 configured for receiving locking pin 70 completely there through. The opposite fixed end of mounting legs 51 may adjoin and connect to weight element 54. The weight element 54 may substantially provide the majority of the engineered effective weight selected for each weight 50 to operably limit the rotational speed of the engine to a preselected maximum RPM in cooperation with other portions of the engine governor system. The mounting legs 51 may be connected to weight element 54 at any suitable location. In various governor system assembly arrangements, the mounting legs 51 may be formed as an integral unitary structural part with weight element 54 or alternatively may be formed separately and connected to weight element 54 by any suitable means, such as for example without limitation welding, soldering, press fit, mechanism fasteners, etc.

Weights 50 may further include lifter arms 57 which are operable to raise a governor spool 101. The governor spool 101 may be slidably mounted on governor shaft 100. In one arrangement, each weight 50 may include a single lifter arm 57 which may be disposed on one of the mounting legs 51 of each weight. The lifter arms 57 may have a free end 58 configured and arranged to abuttingly contact the underside of the governor spool 101 which moves up and down governor shaft 100 to control the engine throttle and speed.

The free ends 58 of the lifter arms 57 may be somewhat enlarged (i.e. in relation to other portions of each arm) or bulbous in some configurations as shown, and may have a convex arcuately-curved camming surface 59 to make smooth contact with the governor spool 101. Lifter arm 57 may be disposed at angle between 0 and 180 degrees to mounting leg 51. In some configurations, lifter arm 57 may be disposed at angle between 0 degrees and about and including 90 degrees, and further between about and including 30 degrees to 90 degrees as shown. Mounting legs 51 and lifter arms 57 may form a generally L-shaped configuration in side view.

Lifter arm 57 may be formed as an integral unitary structural part with mounting leg 51 or alternatively may be formed separately and connected to the mounting leg by any suitable means, such as for example without limitation welding, soldering, press fit, mechanism fasteners, etc.

In top plan view, the weight element 54 of weight 50 may be generally U-shaped in configuration in some possible arrangements. The weight element 54 may include a middle segment 55 and two adjoining end segments 56 which may be orientated at an angle between 0 and 180 degrees to the middle segment. In the non-limiting assembly shown, the end segments may be disposed at about a 90 degree angle or perpendicular to middle segment 55. In some examples, the weights 50 may have end segments 56 that are different lengths, and/or the weights 50 may be symmetrical, so as to allow both of the weights 50 to be in contact with the spool through the full system travel. The balance of the governor gear 30 may gave more to do with the complete system (including the spring and the mass of the weights) than the weights 50 themselves.

In other example systems, the weights 50 may include fewer or more components and may be configured in different ways. For example, the weights 50 may include fewer or more mounting legs 51 or lifter arms 57, which may be positioned in various other configurations. Other variations are possible.

The weight 50 may be made of any suitable material. In one governor system assembly, the weight 50 may be made of metal having a density suitable to provide the desired weight.

In some assemblies, the weight 50 may be case hardened low carbon steel. In other assemblies, the weight 50 may be various other metals or materials.

To mount the weights 50 to governor gear 30, the gear may include one or more mounting brackets 35. In one example assembly, a pair of mounting brackets 35 may each be formed by a single upstanding protrusion. In another example assembly, a pair of mounting brackets 35 may be formed collectively by a cluster/grouping of protrusions that extend vertically from top surface 31 of governor gear 30 and cooperate with locking pin 70 to pivotably secure the weights 50 to the governor gear 30.

Mounting brackets 35 in one non-limiting example include an enlarged horizontally-elongated central block 36 and a pair of end walls 37. Each end wall 37 may be spaced horizontally apart from opposing sides of central block 36 along a pivot axis PA forming a pocket 44 there between. Central block 36 may include an enclosed through-hole 38. The through-hole 38 may be circumscribed on some or all sides by the block and may extend horizontally in one direction along the pivot axis PA through the block from side to side. Each end wall 37 may include an upwardly open groove 39 having an arcuate surface at the bottom in one configuration. The grooves 39 may be horizontally aligned with pivot axis PA and further concentrically aligned with the through-hole 38 in central block 36 for receiving a portion of locking pin 70. As further described herein, locking pin 70 may be axially inserted through holes 53 in mounting legs 51 of weight 50 and the through-hole 38 in central block 36 and grooves 39 of each end wall 37 of the mounting bracket 35 to form a hinged connection between the weight 50 and governor gear 30. Other variations and configurations are possible.

In one governor system assembly 20, a stop wall 121 may be provided which may extend upwards from top surface 31 of governor gear 30. Stop wall 121 may be horizontally spaced apart from one of the end walls 37. Stop wall 121 may be horizontally aligned with pivot axis PA and with the through-hole 38 in central block 36. In some example systems, the end wall grooves 39 may abut or contact with an end of locking pin 70 when inserted through-hole 38 and grooves 39. The stop wall 121 may limit the insertion depth of locking pin 70 through the central block and end walls 37 of the mounting bracket 35 to facilitate mounting of the weights 50. In other systems, the end wall grooves 39 may not necessarily act as a block to the locking pin 70, but may provide an indication to an assembler of which end to insert the locking pin 70 into. Other variations are possible.

In one configuration of governor gear 30, the end walls 37, central block 36, and stop wall 121 may be integrally formed together as a unitary structural part of governor gear 30 to add strength to the protrusion structure of the mounting bracket 35 which forms a hinged connection with the weights 50.

Governor gear 30 may further include an abutment surface 120. The abutment surface 120 may be formed on an upstanding protrusion 43 on the top surface 31 of the gear. When governor gear 30 rotates with increasing speed, the weights 50 will pivot about pivot axis PA and move radially outwards towards opposing peripheral sides 33 of the gear. The abutment surfaces 120 may, in some instances, limit the radial range of movement of the weights 50, particularly during assembly. In some example systems, if the engine assembly was set up properly, the weights 50 may not touch the abutment surfaces 120.

In one possible arrangement, the protrusions 43 may each be positioned on diametrically opposite sides of the governor gear 30 proximate to peripheral sides 33 when the weights are arranged in a diametrically opposing relationship to each other as shown. The abutment surfaces 120 may be configured and positioned on governor gear 30 to abuttingly contact the weight elements 54 of the weights, such as the middle segment 55 in some arrangements. In some systems, the protrusion 43 and abutment surface 120 may have any suitable configuration.

Figure 20:
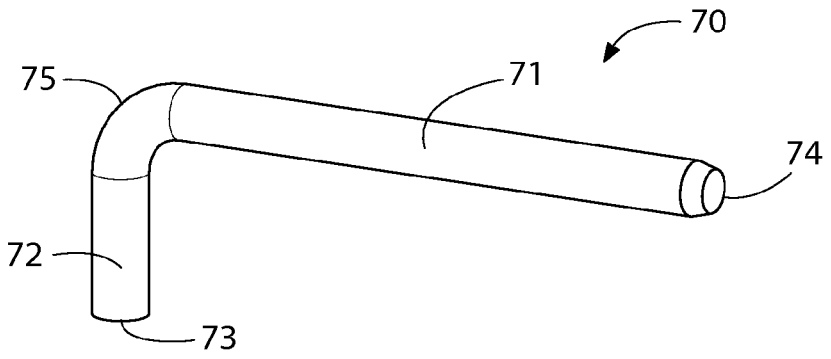
FIG. 20 is a perspective view of an example locking pin.
Figure 21:
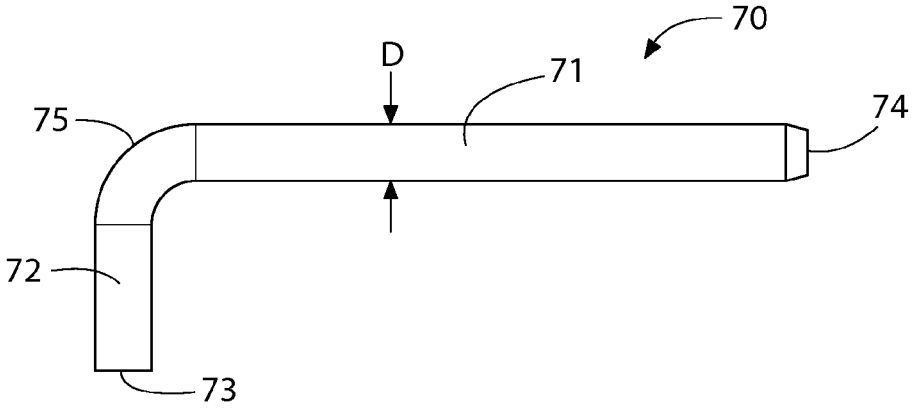
FIG. 21 is a side view thereof.
Figure 22:
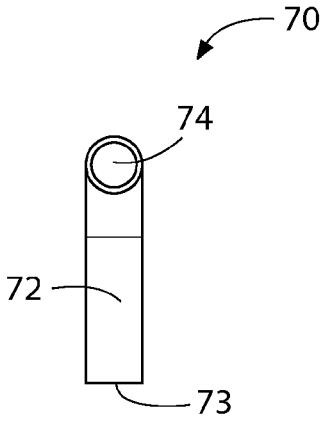
FIG. 22 is an end view thereof.

Referring to FIG. 20-22, the locking pin 70 may rotatably lock a weight 50 to a governor gear 30 via a mounting bracket 35.

In some configurations, locking pin 70 may be a generally L-shaped member including a hinge segment 71 and an adjoining locking segment 72. The hinge segment 71 may define a first hinge segment end 74. The adjoining locking segment 72 may define a second locking segment end 73. In one arrangement, locking segment 72 may be axially offset from and disposed at an angle to hinge segment 71. The locking pin 70 may include a bend 75 between the hinge and locking segments 71, 72. The locking segment 72 may be disposed at an angle to the hinge segment 71 between 0 degrees and 180 degrees. In one configuration, the locking segment 72 may orthogonal to and disposed at about a 90 degree angle (i.e. perpendicular) to the hinge segment 71.

The hinge segment 71 and the locking segment 72 may be various lengths. In some example systems, the hinge segment 71 and the locking segment 72 may be the same length, such that they may be interchangeable or reversible. In such examples, the length of locking segment 72 may provide good retention because of a lever arm that is as long as the hinge segment 71.

In other systems, the hinge segment 71 may be longer than the locking segment 72. For example, in some arrangements, the locking segment may only need to have a length long enough to securely engage the locking slot 80 of the governor gear 30. The hinge segment 71 may have a length long enough to pivotably retain the weight 50 on the governor gear 30.

Locking pin 70 may have a uniform diameter D which may be the same (or may be different) in both the hinge segment 71 and the locking segment 72. The diameter D may be about 2 mm in one non-limiting pin configuration. In some configurations, the hinge segment 71 and the locking segment 72 may have different diameters. The locking pin 70 may be made of any suitable material. In one example, the locking pin 70 may be made of metal such as without limitation mild carbon steel, case hardened or music wire per ASTM A228, or various other metals or materials.

In some systems with a planar top surface 31, the top surface 31 of the governor gear 30 may be considered to define a plane. In one assembly, hinge segment 71 of the locking pin 70 and corresponding pivot axis PA may extend substantially parallel to the plane of the top surface 31 of the governor gear. Locking segment 72 may be rotatable into and out of parallel orientation with the plane of the top surface 31 of the governor gear 30 while the hinge segment 71 may remain parallel to the top surface.

To secure the locking pin 70 in position on governor gear 30, the governor gear 30 may include a pin retaining element which may be configured to removably engage the locking pin 70. In one possible configuration, the pin retaining element may be an elongated locking slot 80 formed through the top surface 31 of governor gear 30 as shown in FIGS. 11-17.

While the discussion herein may refer to the locking pin 70 and locking slot 80 as being removable or removably linked, in some systems, the locking pin 70 and/or locking slot 80 may be configured so that once the locking pin 70 is inserted, the locking pin 70 may not be easily removable, or removable at all. In other systems, the locking pin 70 may be removable from the locking slot 80 after insertion into the locking slot 80. Various examples are possible.

Part of the locking pin 70, such as part of the locking segment 72, may be inserted through, and alternatively removed from, the locking slot 80. Locking slot 80 may be configured to receive and removably engage locking segment 72 of locking pin 70. Locking slot 80 may include a receiving end portion 81 and an opposing locking end portions 82. Receiving end portion 81 may be configured to initially receive locking segment 72 of locking pin 70 into the locking slot 80 in a first unlocked position. Locking end portion 82 of the locking slot 80 may be configured to retain locking segment 72 of locking pin 70 in the locking slot 80 in a locked position.

The locking slot 80 may include a reduced width portion 83 as shown having a width W1. The width W1 of the reduced width portion 83 may be less than the diameter D of the locking segment 72 of locking pin 70 which may be inserted into the locking slot 80. The width W1 of the reduced width portion 83, which may be less than the diameter D of the locking segment 72, may thus enable the locking slot 80 to retain the locking pin 70 on the governor gear 30. In some arrangements, the reduced width portion 83 may be located adjacent to locking end portion 82 of the locking slot 80 to restrain the locking pin 70 from excessive movement in the locking slot 80 when in the locked position.

The width W2 of the receiving end portion 81 of locking slot 80 may be larger than width W1. The width WD of the receiving end portion 81 may be larger than the diameter D of locking segment 72 to permit the end 73 of the locking segment to be easily inserted into the locking slot 80. The width W3 of the locking end portion 82 of the locking slot 80 may be larger than width W1, and/or may be larger than the diameter D of locking segment 72 to retain the locking segment 72. When the locking segment 72 of locking pin 70 is positioned in locking end portion 82 of the locking slot 80, the reduced width portion 83 of the slot may prevent the locking pin from rotating out of the locking end portion under normal operation of the governor system assembly 20. To unlock the locking pin 70 from the locking slot 80, the locking pin may need to be rotated with sufficient force (which may be greater than the force applied during operation of the engine) to pass the reduced width portion 83 and re-enter the receiving end portion 81 of the slot. In an example system, the pin diameter may be between 1.9 and 2.0 mm, W1 may be 1.65 mm, and W2 and W3 may both be greater than 2.0 mm. Many other variations and sizes are possible.

The locking slot 80 may be positioned so that a majority of the length and portion of the slot is offset at least partially from the pivot axis PA of the governor gear 30. In such example systems, the locking pin 70 may be rotated to engage and secure the locking segment 72 with the slot. In one arrangement, the locking slot 80 may be positioned adjacent one of the end walls 37 of the governor gear 30.

The locking slot 80 may take various shapes and dimensions, such that the locking slot 80 may receive, and subsequently restrain a movement of, a portion of the locking pin 70. For example, the locking slot 80 may be oval, rectangular, bean- or peanut-shaped, or various other shapes. The locking slot 80 may retain a portion of the locking pin 70 in various ways, such as with a reduced width portion, clip, strap, or various other retraining mechanisms. Other variations are possible.

Figure 14:
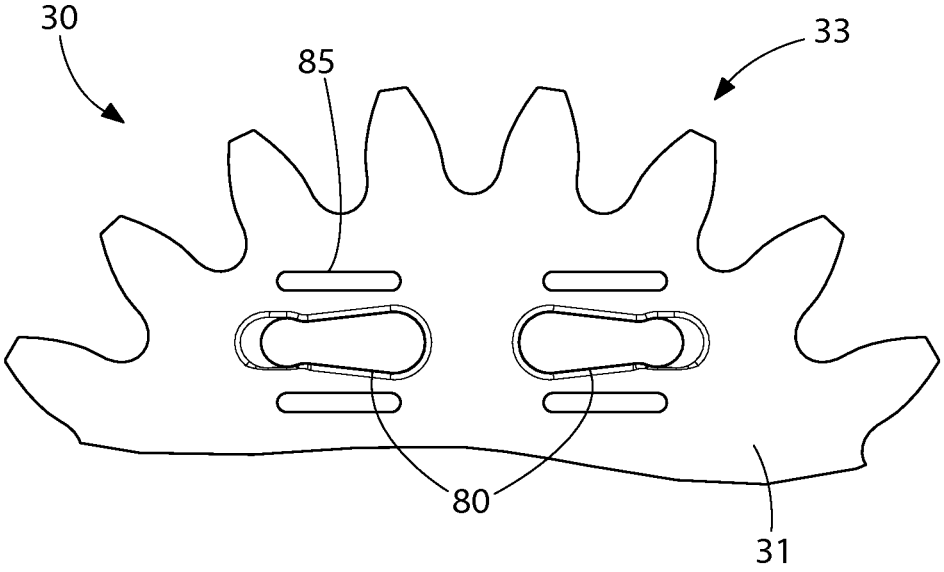
FIG. 14 is an enlarged detail view of a portion of the example governor gear taken from FIG. 11 showing an alternative configuration.
Figure 15:
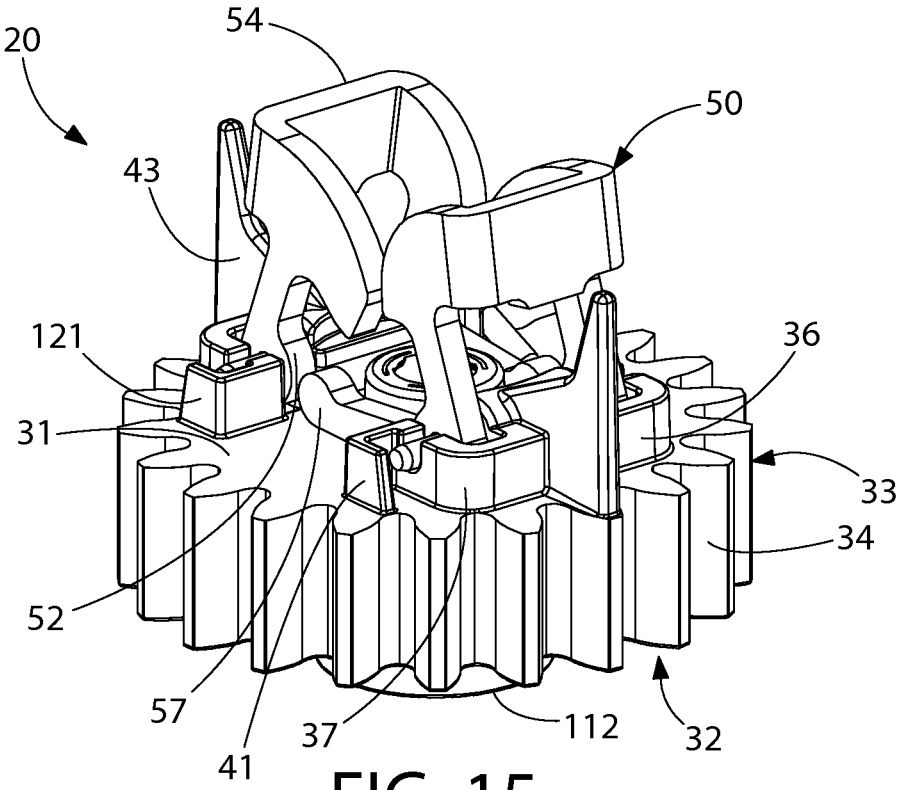
FIG. 15 is top perspective view of the example governor system assembly of FIG. 1 showing the rear non-locking portion of the governor gear.

In some arrangements, one or more elongated recesses 85 may be formed in governor gear 30 proximate to, but slightly spaced apart from locking slot 80 at least near the reduced width portion 83 as shown in FIG. 14. This may add lateral flexibility to the reduced width portion 83 of the gear when a portion of the locking portion (e.g. locking segment 72) passes through the reduced width portion. As an example, if the dimension for W1 were set too tight, the relief from the recesses 85 may allow for the W1 to flex. Many other advantages and alternatives are possible.

In some systems, the recesses 85 may extend completely through the gear from the top to bottom surfaces 31, 32. In other configurations, the recesses 85 may extend only partially into the gear body from the top surface 31 or bottom surface 32, and may be configured as depressions which do not penetrate the opposing surface. In some other configurations, the recesses 85 may be cavities formed within the governor gear 30, and may not extend through either of the top surface 31 or bottom surface 32.

In some systems, there may be two recesses 85 for each locking slot 80, with each recess 85 positioned on each longitudinal side of the locking slot 80. In other systems, there may be one recess 85 for some or all of the locking slots 80. The recess 85 in some of these systems may be positioned one longitudinal side of the locking slot 80 (such as on an interior side of the locking slot 80, or on an outer side of the locking slot 80. The recess 85 in other of these systems may be positioned partially or completely below the locking slot 80.

The recesses 85 may have various different shapes and sizes. For example, in some systems, the recess 85 may be circular, rectangular (with sharp or rounded corners), oval, peanut-shaped, or various other shapes.

The recesses 85 may be positioned at various distances from the locking slots 80. In some systems, the recess 85 may be positioned a distance from the locking slot 80 such that the material between the slot and the recess may be temporarily deformed without breaking or cracking the material. For example, the recess 85 may be generally positioned adjacent to the locking slot 80 such that when the locking segment 72 of the locking pin 70 is inserted past the reduced width portion 83 of the locking slot 80, the material of the governor gear 30 between the recess 85 and the locking slot 80 is pushed toward the recess 85, temporarily increasing the size of the locking slot 80 to at least the width of the diameter D and temporarily decreasing the area of the recess 85. Once the locking segment 72 moves past the reduced width portion 83, the material of the governor gear 30 between the recess 85 and the locking slot 80 moves back toward the locking slot 80, reducing the width W1 of the locking slot 80 to a width less than the diameter D, holding the locking segment 72 (and thus the locking pin 70) in the locking slot 80. Other variations are possible.

Figure 13:
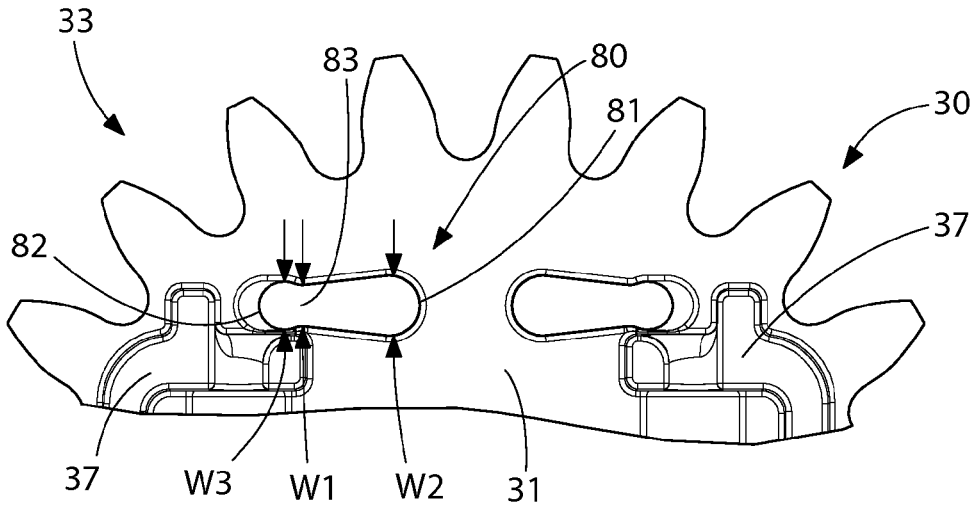
FIG. 13 is an enlarged detail view of a portion of the example governor gear taken from FIG. 11.

Locking slot 80 may be generally keyhole shaped in some configurations as best shown in FIG. 13 with the reduced width portion 83 of the slot being located proximate to the locking end portion 82 of the slot. Any suitable shaped locking slot configuration may be provided so long as the slot includes a reduce width portion adjacent to the locking end portion of the slot.

Figure 18:
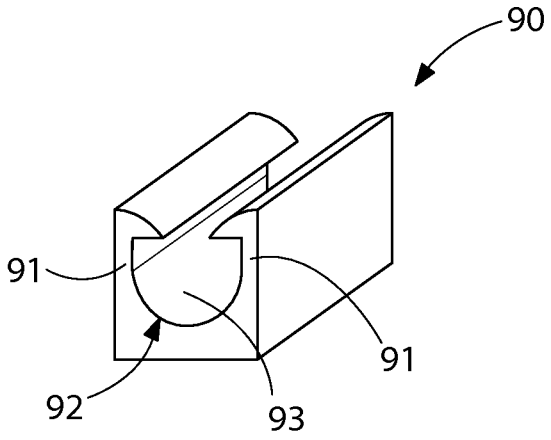
FIG. 18 is a perspective view showing an example locking clip for securing the locking pin to the governor gear.
Figure 19:
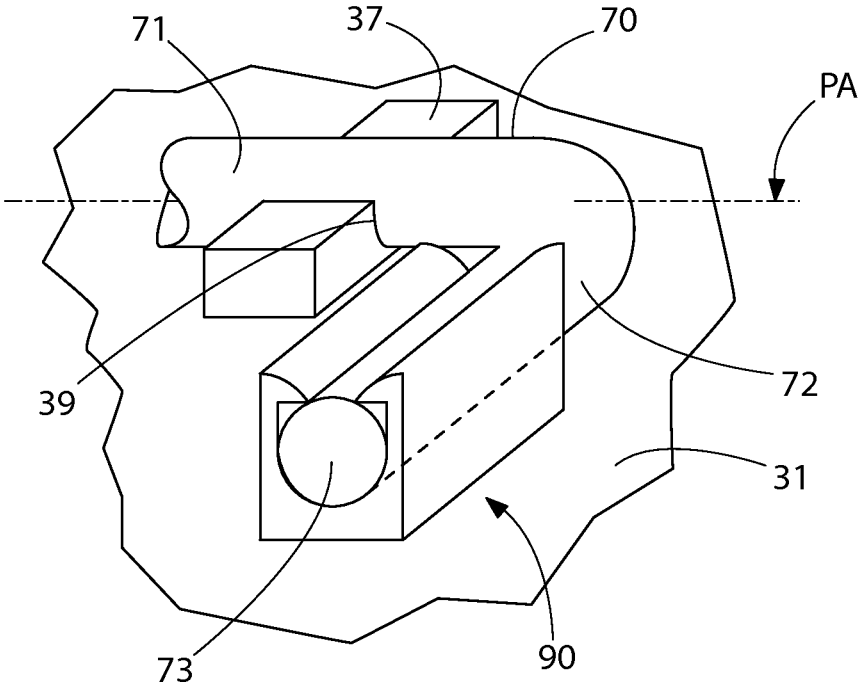
FIG. 19 is a perspective view thereof with the example locking pin in a locked position on the example governor gear.

In other possible configurations, the pin retaining element may be configured as a locking protrusion in the form of a resilient locking clip 90 which extends upwards from the top surface 31 of the governor gear 30 as shown in FIGS. 18-19. The locking clip 90 may be positioned so that it is offset at least partially from the pivot axis PA of the governor gear 30 so that the locking pin 70 may be rotated to engage and secure the locking segment 72 with the clip. Locking clip 90 may be a snap-lock device including a recess 92 with arcuate seating surface 93 and a pair of opposing resiliently formed spaced apart ears 91 flanking each side of the recess. The recess 92 may be open from the top so that the locking segment 72 of the locking pin 70 may be pushed downwards into and received by the recess. The ears 91 may be constructed to flex laterally outwards when the locking segment 72 of locking pin 70 is pushed down between the ears and into the recess 92, and then return inwards after the locking pin positioned on seating surface 93. The gap formed between the ears 91 may be sufficient to receive the locking segment 72 of locking pin 70 there through and snap lock the pin into place to secure the pin to the governor gear 30. The upper free ends of the ears 91 may be terminated with inwardly angled or curved barbs to retain the locking pin in the locking clip 90. Other variations of a locking clip are possible. In one assembly, the locking clip 90 may be integrally formed with the governor gear 30 and mounting brackets 35.

An exemplary method for assembling a governor system assembly will now be described with reference to a governor system assembly 20 having locking slots 80.

The process may begin with providing the governor gear 30, weights 50, and locking pins 70 in an unassembled condition, which may be provided in the form of a governor system assembly kit (2505). The kit may include one governor gear (or base), a pair of weights, and a pair of locking pins. In other systems, the kit may include fewer or more components.

Taking the foregoing components, one of the weights 50 may be positioned on the top surface 31 of the governor gear 30 (2510). The mounting ends 52 of the mounting legs 51 may each be positioned in a pocket 44 on governor gear 30 formed between the central block 36 and end walls 37 (2515). The holes 53 on each mounting leg 51 of weight 50 may also be concentrically aligned with the through-hole 38 of the central block 36 and each groove 39 in the end walls 37 along the pivot axis PA (2520).

With the weight 50 in the foregoing position, the hinge segment end 74 and hinge segment 71 of the locking pin 70 may be slidably and axially inserted in a first axial direction through the grooves 39 and through-hole 38 of the governor gear 30 and the holes 53 in each mounting leg 51 of the weight 50 along the pivot axis PA (2525). In one arrangement, the hinge segment 71 is inserted from a proximal peripheral side 33 of gear where the locking slots 80 are located. The hinge segment 71 of the locking pin 70 may be inserted until the hinge segment end 74 enters the gap 45 between stop wall 121 and the distal-most end wall 37 (i.e. near the distal peripheral side 33 of governor gear 30 opposite the original insertion point of the pin). The weight 50 may not be removed from the governor gear 30 at this juncture in the governor system assembly process. In one assembly process, the locking pin 70 may be inserted until the locking segment 72 is rotatably aligned with the locking slot 80. This position of the locking pin 70 may be referred to as the "unlocked position" as shown in FIGS. 1, 2, 5, and 17 wherein the locking segment 72 is not secured in the locking slot 80 and may be rotated in opposing rotational directions about the pivot axis PA. Furthermore, it should be noted that the locking pin 70 may still at this juncture be axially moved in two opposing directions along the pivot axis PA.

Figure 16:
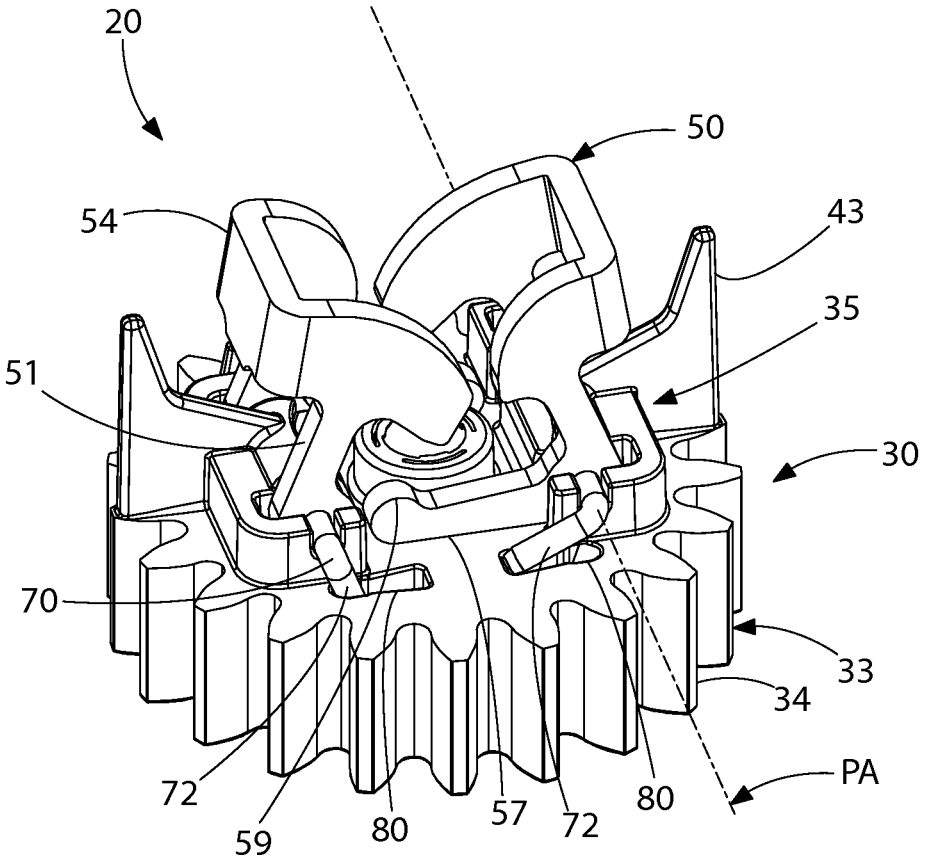
FIG. 16 is a top perspective view of the example governor system assembly of FIG. 1 showing the front locking portion of the gear with locking pins in various stages of rotational engagement with locking slots formed in the governor gear.
Figure 17:
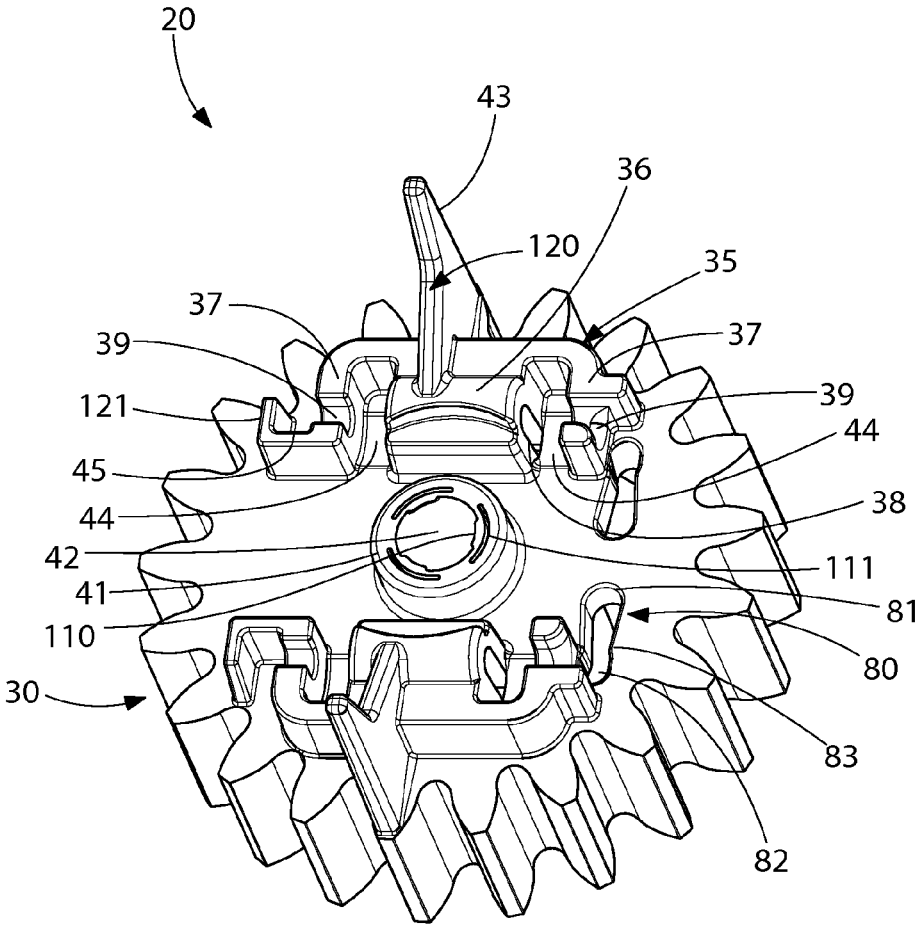
FIG. 17 is a top perspective view showing details of an example mounting bracket used for mounting the weights to the governor system assembly via the locking pin.

With the locking pin 70 in the foregoing position, the locking pin may be rotated in a first rotational direction so that the locking segment 72 moves downwards towards top surface 31 of governor gear 30 (2530). The locking segment end 73 may initially enter the top of the locking slot 80 and is positioned in the receiving end portion 81 of the slot. A majority of the length of the locking segment 72 of locking pin 70 may remain outside of and above the locking slot 80. This position of the locking pin 70 may be referred to as the "pre-engagement position" as shown in FIG. 16 (right locking pin). The locking segment 72 may be contacting and resting on the reduced width portion 83 of the locking slot 80, but may not yet be secured in the slot. The locking pin 70 is now ready to be locked in place on governor gear 30.

Figure 23:
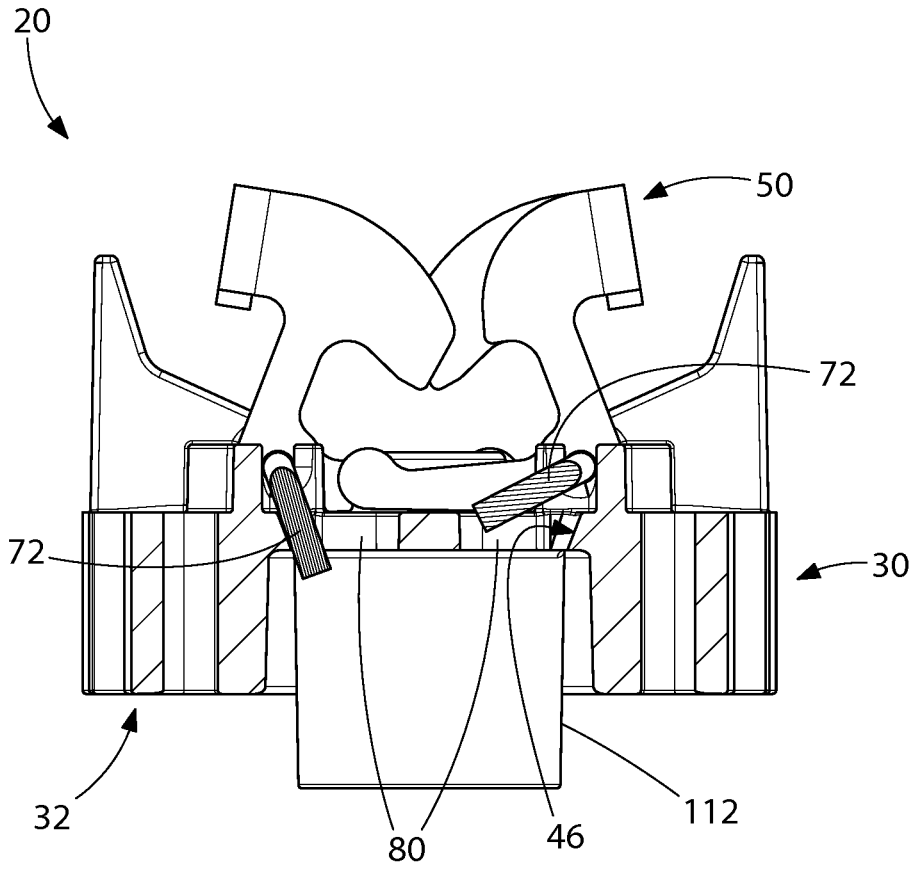
FIG. 23 is cross-sectional view through an example governor system assembly showing locking pins in locked and unlocked positions.

From the pre-engagement position, the locking pin 70 may then be further rotated in the first rotational direction with sufficient force to push the locking segment 72 through the reduced width portion 83 of the locking slot 80 and into the locking end portion 82 of the slot (2535). The locking pin 70 may noticeably "snap" into this position, and is engaged and locked into the locking end portion 82 of the slot and the governor gear 30 via a snap lock. This engaged position of the locking pin 70 may be referred to as the "locked position" as shown in FIGS. 1, 16, and 23 (left locking pin). The locking segment end 73 of the pin may be positioned below the locking slot 80 within cavity 40 below the recessed surface 32*a* of the governor gear 30. A majority of the length of the locking segment 72 of locking pin 70 may be inserted through top surface 31 of governor gear 30 into locking slot 80 as shown in contrast to the "unlocked position." The locking segment 72 may abuttingly contact a stop surface 46 formed in each locking slot 80 and may be trapped in locking end portion 82 of the slot between the stop surface and the reduced width portion 83.

In the locked position of locking pin 70, the locking segment 72 of the pin may be disposed at an angle between 0 and 180 degrees to the top surface 31 of governor gear 30, and between 0 and about 90 degrees in some arrangements when the locking segment engages the stop surface 46. In one example, without limitation, the locking segment 72 may be disposed at an angle of about 20 degrees.

It should be noted that the angled locking segment 72 of the locking pin 70 when engaged with the governor gear 30 (via locking slot 80) fixes the rotational position of the locking pin and advantageously prevents the hinge segment 71 of the locking pin from being axially moved or withdrawn along the pivot axis PA from the mounting legs 51 of the weight 50, thereby ensuring that the weights remain mounted on the gear. The centrifugal forces acting created by the rotating governor gear 30 may otherwise tend to drive the locking pin 70 outwards along the pivot axis PA. Accordingly, the selective engagement of the locking pin 70 with the governor gear via locking slot 80 serves to both retain the locking pin and weights 50 on the governor gear.

The foregoing assembly process may be repeated for the remaining weight 50 with another locking pin 70 (2505-2535), which (in a two-weight system) may complete the entire governor system assembly 20. To remove a weight 50 from the gear assembly, the locking pin 70 may be rotated in a second rotational direction (opposite the first rotational direction) with sufficient force to push the locking segment 72 of locking pin 70 back through the reduced width portion 83 and into the receiving end portion 81 of locking slot 80 to the unlocked position. The locking segment end 73 may be lifted out of and positioned above the locking slot 80 and top surface 31 of the governor gear 30. With the locking segment 72 of the locking pin 70 now no longer positioned in the locking slot 80, the hinge segment 71 of the locking pin may be freely axially withdrawn in a second opposite axial direction from the central block 36 and end walls 37 of governor gear 30 and weight mounting legs 51. With the locking pin 70 fully removed, the weight 50, may be removed from the governor gear 30.

It will be appreciated and understood by those skilled in the art that the forgoing governor system assembly process may also be replicated in a similar manner using locking clip 90 instead of a locking slot 80 (see, e.g. FIGS. 18 and 19). With the locking segment 72 of the locking pin 70 being engaged with the locking clip 90, axial withdrawal of the locking pin from the mounting legs 51 of weight 50 is similarly prevented.

In operation, the governor gear 30 may be mounted inverted 180 degrees from the orientation shown in FIG. 1. The weights 50, under the force of gravity before the engine runs and governor shaft 100 rotates will hang and be positioned closest to the shaft at the center of the governor gear 30. Once the engine starts, the governor gear 30 which is driven by the cam gear (not shown) may rotate about the governor shaft 100 which defines a rotational axis RA. The weights 50 each may pivot radially outwards about the pivot axis PA defined by locking pin 70 as the governor gear 30 rotates. The free ends 58 of the lifter arms 57 may move axially along governor shaft 100 and push against the governor spool 101 thereby moving the spool in position along the shaft. The governor spool 101 in turn may push against a linkage tied to the throttle to limit and control the speed of the engine.

Figure 26:
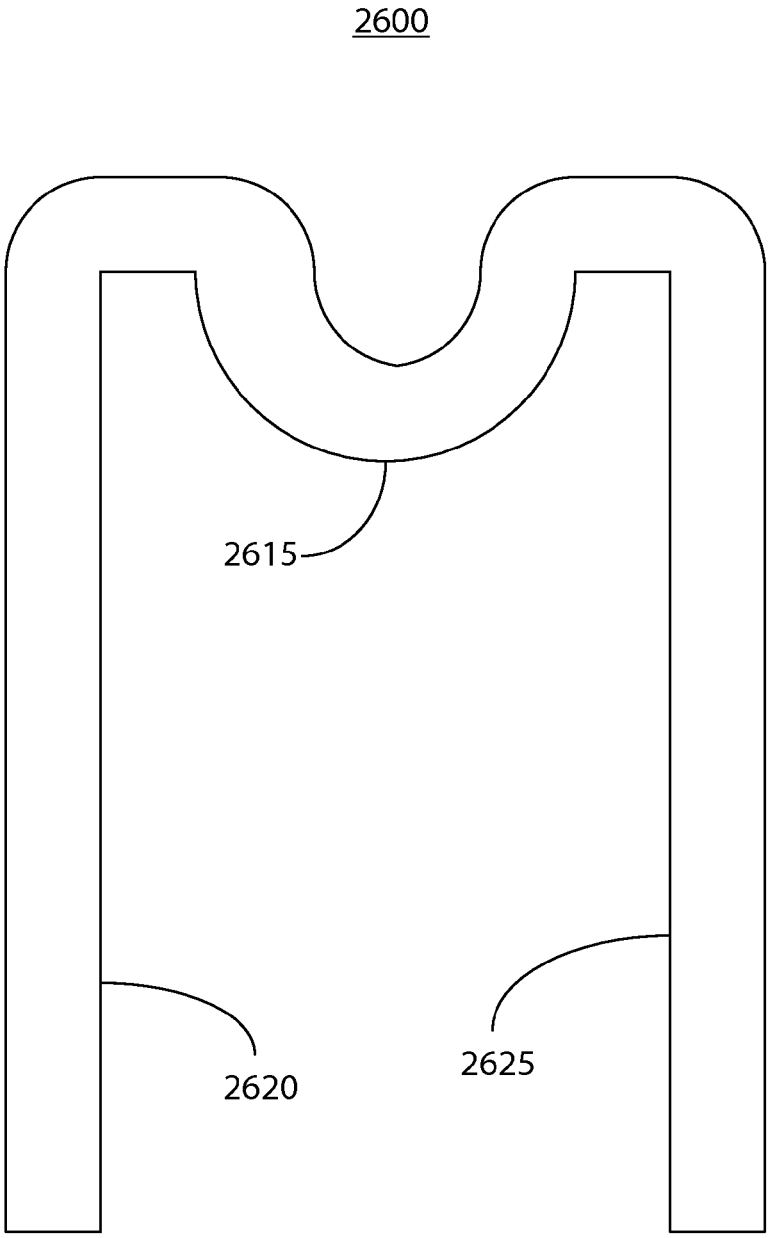
FIG. 26 is a top view of an example locking pin for use with an example governor system assembly.
Figure 27:
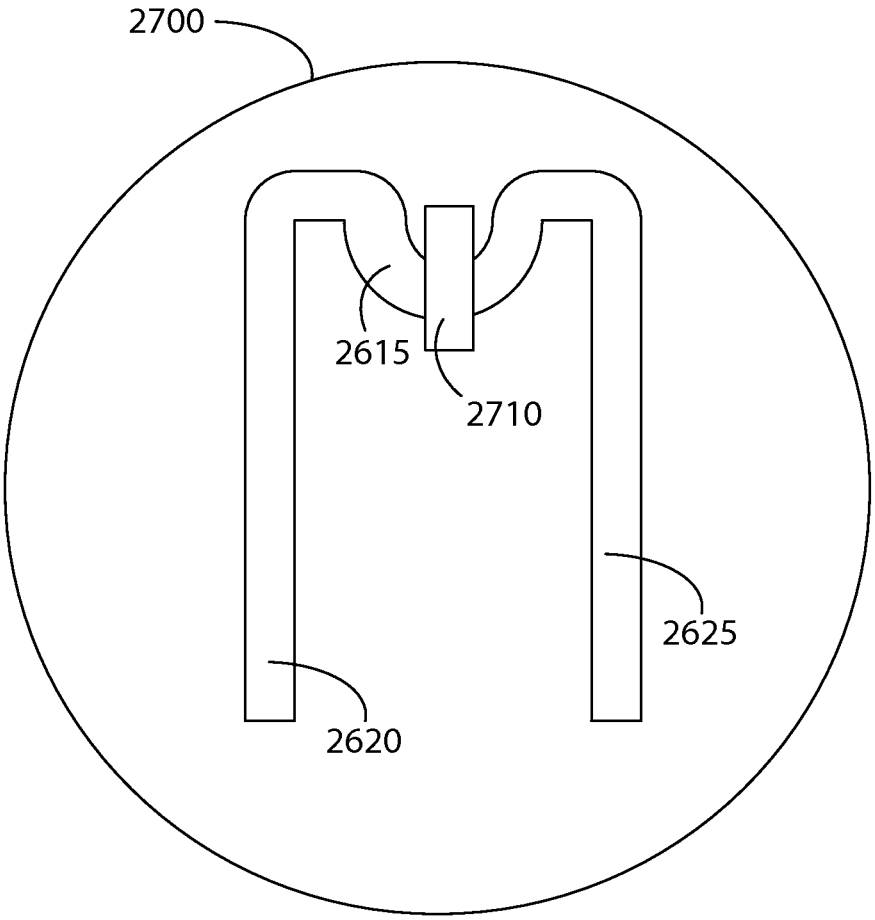
FIG. 27 is a top view of an example governor system assembly.

FIGS. 26 and 27 show another example locking pin 2600 that may be used with governor system assembly 20. The locking pin 2600 may be a M- or U-shaped locking pin with two hinge segments 2620 and 2625. Each of the hinge segments 2620 and 2625 may be used to lock or attach a weight 50 to a gear 30 or other base (such as base 2700) of the assembly. In this way, the hinge segments 2620 and 2625 may operate similar to the hinge segments 71 of an L-shaped locking pin 70.

The locking pin 2600 may also include a locking segment 2615. The locking segment 2615 may connect the two hinge segments 2620 and 2625. In some examples, the hinge segment 2615 may be configured so that the locking pin 2600 forms a M- or U-shape.

The locking segment 2615 may be secured to the gear 30 or base 2700. The base 2700 may include a locking fastener 2710. In some instances, the locking fastener 2710 may be a clip or other fastening mechanism for receiving and holding the locking segment 2615 of the locking pin 2600. For example, the locking fastener 2710 may be similar to or resemble the locking clip 90. Many other variations and types of locking pins 70 and 2600 may be possible.

While the foregoing description and drawings represent some example systems, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A governor system assembly for an engine, the assembly comprising:

a governor gear;

a weight;

a locking pin pivotably coupling the weight to the governor gear along a pivot axis, the locking pin having a locking segment selectively rotatable into engagement with the governor gear about the pivot axis for securing the locking pin to the governor gear;

wherein the locking pin is rotatable between an unlocked position in which the locking segment disengages the governor gear and a locked position in which the locking segment engages the governor gear.

2. The assembly of claim 1, wherein the locking pin is axially removable from the governor gear along the pivot axis in the unlocked position and the locking pin is not axially removable from the governor gear in the locked position.

3. The assembly of claim 1, wherein the locking pin further includes a hinge segment which pivotably couples the weight to the governor gear.

4. The assembly of claim 3, wherein the locking segment of the locking pin is arranged off axis from the hinge segment.

5. The assembly of claim 1, wherein the locking pin is generally L-shaped.

6. The assembly of claim 1, wherein the governor gear includes a pin retaining element configured to engage the locking segment of the locking pin.

7. The assembly of claim 6, wherein the pin retaining element is an elongated locking slot.

8. The assembly of claim 7, wherein the locking segment forms a snap-lock with the locking slot to fix the locking pin in rotational position.

9. The assembly of claim 6, wherein the pin retaining element is a locking protrusion disposed on a top surface of the governor gear, the locking protrusion being configured to engage and retain the locking segment of the locking pin.

10. A governor system assembly for an engine, the assembly comprising:

a governor gear defining a locking slot;

a weight;

a locking pin having a hinge segment pivotably coupling the weight to the governor gear along a pivot axis, and a locking segment rotatable into engagement with the locking slot of the governor gear about the pivot axis;

wherein the locking pin is selectively rotatable between an unlocked position in which the locking segment disengages the locking slot and a locked position in which the locking segment engages the locking slot.

11. The assembly of claim 10, wherein the locking pin engages holes formed in the governor gear and the weight to pivotably coupled the weight to the governor gear.

12. The assembly of claim 10, further comprising a recess formed in the governor gear proximate to and spaced apart from the locking slot which adds lateral flexibility to the slot.

13. The assembly of claim 10, wherein the locking segment of the locking pin defines a first end which extends downwards into the locking slot when the locking pin is in the locked position.

14. The assembly of claim 10, wherein the locking slot includes a receiving end portion, a locking end portion, and a reduced width portion between the receiving and locking end portions, wherein the reduced width portion has a width which is slightly less than a diameter of the locking segment of the locking pin, the locking segment being rotatable from the receiving end portion of the locking slot through the reduced width portion into the locking end portion of the locking slot.

15. The assembly of claim 10, further comprising a governor shaft extending through a center of the governor gear, the governor shaft including a governor spool engaged with the weight, wherein the weight includes a lifter arm which is operable to lower and raise the governor spool upon rotation of the governor gear.

16. The assembly of claim 15, wherein the governor gear further includes a central hub having a plurality of radially extending lips configured to frictionally engage the governor shaft; and an arcuately curved channel disposed in the hub proximate to each of the lips.

17. A method for assembling a governor system assembly, the method comprising:

providing a governor base, a weight, and a locking pin;

locating the weight on the governor base;

axially inserting a first segment of the locking pin through the weight and governor base, the weight being pivotably coupled to the governor base along a pivot axis;

rotating a second segment of the locking pin about the pivot axis in a first direction; and engaging the second segment with the governor base, wherein the locking pin is locked to the governor base;

wherein rotating the second segment of the locking pin about the pivot axis in second direction opposite the first direction disengages the second segment from the governor base to unlock the locking pin from the governor base.

18. The method of claim 17, wherein the axially inserting includes inserting the first segment of the locking pin through holes formed in the governor base and weight.

19. The method of claim 17, wherein the engaging includes inserting the second segment of the locking pin into a locking slot formed through a top surface of the governor base.

* * * * *